United States Patent [19]

Johnson

[11] 4,268,292

[45] May 19, 1981

[54] METHOD AND APPARATUS FOR FORMING GLASS FILAMENTS

[75] Inventor: Donald T. Johnson, Newark, Ohio

[73] Assignee: Owens-Corning Fiberglas Corporation, Toledo, Ohio

[21] Appl. No.: 77,972

[22] Filed: Sep. 24, 1979

[51] Int. Cl.[3] ..... C03B 37/02

[52] U.S. Cl. ..... 65/2; 65/11 R; 83/913; 226/91; 226/92

[58] Field of Search ..... 65/2, 11 W, 11 R; 83/913; 226/91, 92

[56] References Cited

U.S. PATENT DOCUMENTS

| | | | |
|---|---|---|---|
| 3,414,956 | 12/1968 | Genson | 65/11 W X |
| 4,163,653 | 8/1979 | Symborski et al. | 65/2 |
| 4,175,939 | 11/1979 | Nakazawa et al. | 65/11 R X |
| 4,194,896 | 3/1980 | Symborski et al. | 65/11 R X |

*Primary Examiner*—Robert L. Lindsay, Jr.
*Attorney, Agent, or Firm*—Ronald C. Hudgens; Philip R. Cloutier; Greg Dziegielewski

[57] ABSTRACT

Method and apparatus for forming glass filaments comprised of (a) a plurality of spaced apart forming sections wherein each section is comprised of (i) a feeder adapted to supply a plurality of streams of glass to be attenuated into continuous filaments, a zone being defined by the paths of the free-falling streams, (ii) applicator means laterally spaced from said zone adapted to apply a coating to the advancing filaments, (iii) first guide means laterally spaced from said zone adapted to gather the filaments into a strand, the guide means and applicator being positioned such that the coating is applied to the filaments at a region external to said zone and intermediate the feeder and the first guide means along the path of advancement of the filaments, (iv) secondary attenuation means laterally spaced from the zone adapted to advance the filaments as waste, (b) a single primary attenuation means adapted to simultaneously attenuate the streams from each section into filaments; and (c) second guide means positioned to advance the strands from each section external to all of said zones when the strands are being advanced by the primary attenuation means, said feeders, applicator means, first guide means and second guide means being positioned such that all of said strands are advanced along paths external to all of said zones and in the absence of contact with any other of said strands when any of the waste strands are advanced by the secondary attenuation means, said second guide means being adapted to position each of said strands independent of the remainder of said streams at said primary attenuation means.

3 Claims, 5 Drawing Figures

METHOD AND APPARATUS FOR FORMING GLASS FILAMENTS

TECHNICAL FIELD

The invention relates to method and apparatus for forming continuous filaments and severing them in a continuous operation.

BACKGROUND ART

Many times it is desirable to form a strand consisting of a very large number of filaments. Generally, a number of smaller strands consisting of a plurality of filaments in each are combined in a roving process to produce a single large strand or roving of a large number of filaments. To accomplish this, filaments are pulled from a feeder and wound upon a forming tube being rotated by a winder to form a subpackage. Such subpackages are positioned as a group to remove each of the strands therefrom to combine the substrands into a larger strand by the action of yet another winder as is known in the art. Or, the combined strand can be pulled by the action of a cot wheel and a chopper to deliver a large number of continuous filaments to be cut into discrete segments.

Generally, a reduction in the equipment utilized in the steps employed in producing such a strand containing a large number of filaments can lead to improved efficiencies and reduced costs. This is especially practical where all of the filaments can be attenuated by the action of a single attenuation means located on a single level of a forming room.

Systems for producing chopped glass segments from a plurality of spaced apart bushings have been employed before. But, due to the orientation of the bushings, coating applicators, gathering shoes, idler rolls, scrap pull rolls and the like, a strand break out could disrupt at least a portion of the remaining forming operation, if an intermediate forming section was disrupted.

Furthermore, in the production of discrete fibers or chopped strand, it is desirable to concomitantly pull continuous glass fibers from a plurality of spaced apart feeders adapted to supply a strand or plurality of strands to the chopper wherein the cot wheel of the chopper acts as a pull wheel to attenuate the streams of molten material issuing from the feeders into filaments. In drawing the filaments from a plurality of bushings to be advanced through the chopper, it is possible to maintain production from a number of bushings even though one or more bushings may be disrupted. With the bushings and other apparatus oriented to provide continuous operation in spite of a disruption of one or more bushings, it is desirable to have the operator restart the disrupted feeder to again supply filaments to the chopper in the absence of disrupting the operations of the other bushings.

To accomplish this, the filaments must be continuously attenuated from all bushings still in operation. Thus, the chopper cannot be stopped. However, with high speed operations it is difficult and sometimes undesirable to try to rethread the chopper at high speed. Therefore, the rotational speed of the chopper must be reduced to allow the operator to rethread the strand but yet maintain a speed sufficient to attenuate filaments from the other bushings to prevent substantial disruptions therein.

To facilitate operation, including rethreading, the guide means intermediate the chopper and the forming sections has been designed to promote strand separation.

DISCLOSURE OF THE INVENTION

This invention pertains to apparatus for forming glass filaments comprised of (a) a plurality of spaced apart forming sections wherein each section is comprised of (i) a feeder adapted to supply a plurality of streams of glass to be attenuated into continuous filaments, a zone being defined by the paths of the free-falling streams from said feeder, (ii) applicator means laterally spaced from said zone adapted to apply a coating to the advancing filaments, (iii) first guide means laterally spaced from said zone adapted to gather the filaments into a strand, the guide means and applicator being positioned such that the coating is applied to the filaments at a region external to said zone and intermediate the feeder and the first guide means along the path of advancement of the filaments, (iv) secondary attenuation means laterally spaced from the zone adapted to advance the filaments as waste; (b) a primary attenuation means adapted to simultaneously attenuate the streams from each section into filaments; and (c) second guide means positioned to advance the strands from each section external to all of said zones when the strands are being advanced by the primary attenuation means, said feeders, applicator means, first guide means and second guide means being positioned such that any of said strands are advanced along paths external to all of said zones and in the absence of contact with any other of said strands when any of the waste strands are advanced by the secondary attenuation means, said second guide means being adapted to position each of said strands spaced from the remainder of said strands at said primary attenuation means.

It is an object of this invention to provide a system wherein the filaments from a plurality of spaced apart feeders can be readily rethreaded to be simultaneously attenuated by the action of a single primary attenuation means regardless of forming disruption to some of the forming sections associated with the primary attenuation means.

The foregoing as well as other objects of the present invention, will become apparent to those skilled in the art from the following detailed description.

BEST MODE OF CARRYING OUT THE INVENTION

Figure 2:
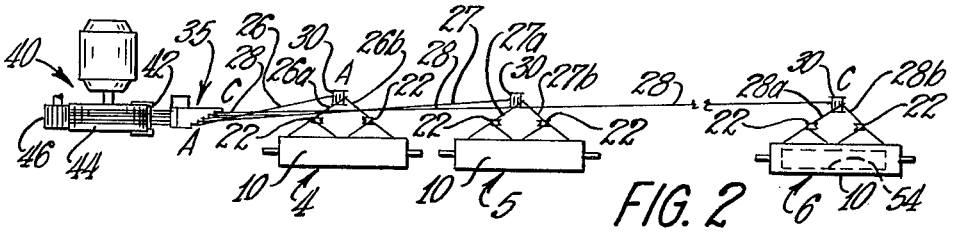
FIG. 2 is a plan view of the forming system shown in FIG. 1.
Figure 1:
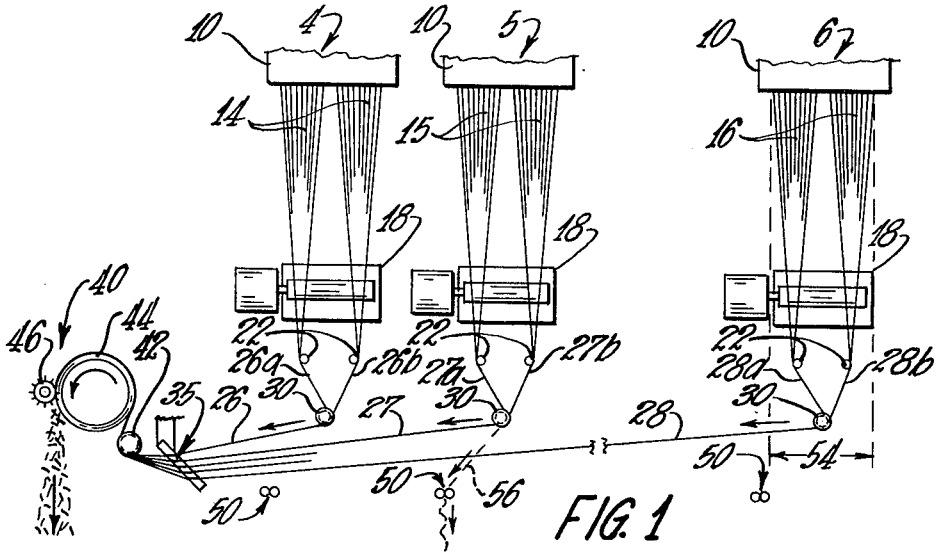
FIG. 1 is a front elevational view of the multifeeder forming system according to the principles of this invention.

As shown in FIGS. 1 and 2, the forming system is comprised of spaced apart continuous filament forming sections 4, 5, and 6 which are associated with a primary attenuation means or chopped strand forming means 40. Thus, a single attenuation means is adapted to attenuate and advance all of the filaments from all of the forming sections. As such, the primary attenuation means 40 can be a winder, pull wheel, or a chopper for forming discrete fibers or chopped strand as is known in the art.

U.S. Pat. No. 4,163,653 issued on Aug. 7, 1979 to Symborski et al is hereby incorporated by reference; the present invention provides a modified second guide means for the method and apparatus described therein.

As shown, each forming section 4, 5, and 6 is comprised of a stream feeder or bushing 10, size or coating applicator 18, gathering shoes or guide means 22, an idler roll or guide means 30 and secondary attenuation means 50, all of which can be of the type well known in the glass fiber forming art.

In operation, each of the feeders 10 supply a plurality of streams of molten glass to be attenuated into filaments by the action of the primary attenuation means 40 or secondary attenuation means 50. In any glass fiber forming operation, occasionally, some of or all of the filaments from any bushing will break and the attenuation process will be halted. During restart, "bead down" can occur wherein the streams of molten material leave the feeder as beads of molten glass. If left unattended in a free fall condition, the beads or streams will move along a path defining a vertically extending zone beneath feeder 10.

To establish a continuous and efficient operation, it is imperative that such forming equipment as the applicators 18, gathering shoes 22, idler rolls 30, and scrap pull rolls or secondary attenuation means 50 be positioned external to such zone to keep such equipment out of the free fall path of the beads or streams.

As shown in the drawings, applicator 18, gathering shoe 22, idler roll 30, and secondary attenuation means 50 are laterally spaced to the same side of zone 54. Generally, it is preferred that such equipment be on the side of the zone 54 opposite the side of the zone where the operator is normally positioned. With such an orientation, the operator has easy access to the bottom region of the feeder while permitting easy access to coating applicator 18, gathering shoe 22, idler roll 30 and scrap pull roll 50.

During production, feeders 10 of forming sections 4, 5, and 6 supply a plurality of streams of molten glass to be attenuated into continuous filaments 14, 15 and 16. Each of such filament is advanced along a path external to the zone 54 of each of the plurality of forming sections. Each of the applicators 18 is fixed external to the zone and laterally spaced therefrom such that the applicator surface, which can be a rotatable roll wet with a suitable liquid size and/or binder or coating, as is known in the art, is located laterally spaced from the zone. The liquid is applied to the filaments at a region laterally spaced from the zone.

Gathering shoes 22 are laterally spaced farther from the zone in the same direction as applicators 18 to bring the filaments into contact with the applicator roll. Gathering shoes 22 further serve to gather the filaments into a substrand and guide the strand along a path external to the zones 54. From gathering shoes 22 the substrands 26*a* and 26*b*, 27*a* and 27*b*, 28*a* and 28*b* are advanced to idler rolls 30 associated therewith to form strands 26, 27, and 28, respectively.

Strands 26, 27, and 28 are advanced to second guide means 35 which is laterally spaced from the same side of zones of all of the forming sections 4, 5, and 6. Gathering shoes 22 can be considered a first guide means or the combination of gathering shoes 22 and idler rolls 30 can work in conjunction as a first guide means. The second guide means 35 is positioned in a horizontal plane below the horizontal plane or zone containing the first guide means such that the strands 26, 27, and 28 are maintained in a spaced apart relationship until such strands substantially reach second guide means 35. As shown in FIG. 1, second guide means 35 is located in a horizontal plane beneath the horizontal plane containing idler rolls 30 of sections 4, 5, and 6. With the strands 26, 27 and 28 in a spaced apart relationship on second guide means 35, it is easier to restart individual strands than if the strands were gathered together at that point.

Strands 26, 27, and 28 are then advanced as an array of spaced apart strands to primary attenuation means 40, and the array of strands is positioned in a plane substantially parallel to the axis of rotation of cot roll 44. As shown in FIG. 1, primary attenuation means 40 is comprised of an idler roll 42, a cot roll 44, and a cutter roll 46 having a plurality of radially projecting cutting edges as found in choppers well known in the art. Cot roll 44 acts as a pull wheel and idler roll 42 is positioned to bring the array of strands into engagement with the surface of cot roll 44 in a non-slipping engagement such that all of the streams from all of the bushings 10 are simultaneously attenuated into filaments. As the strand contacting the surface of cot roll 44 passes through the region where cutter roll 46 pierces the elastomeric surface of cot roll 44, the continuous glass filaments or strands are cut into discrete segments.

As shown, second guide means 35 is positioned such that strands 26, 27, and 28 are all advanced along paths external to each of the zones 54 of sections 4, 5, and 6 and paths spaced apart from each other, even at the chopper. Thus, if one of the sections should be disrupted at any time, the streams or beads thereof will not contact the remaining advancing strands and disrupt the entire operation.

During start-up or restart, the filaments can be normally in contact with the applicator 18, gathering shoe 22 and idler roll 30, with the strand being advanced as waste material since the secondary attenuation means 50 is normally of the type in which the filaments are pulled at a lower speed than by the primary attenuation means.

As shown in the drawings, the secondary attenuation means or scrap rolls 50 are also positioned or laterally spaced to the same side of zone 54 as applicator 18. However, the secondary attenuation means is positioned closer to zone 54 than idler rolls 30, such that the waste strand 56 is advanced downward and forward in the absence of contacting, for example strand 28, when an interior forming section, such as section 5, employs secondary attenuation means 50 to preclude the fouling of strands and/or interfilament abrasion.

It is preferred that the scrap rolls 50 be located closer to zone 54 than idler roll 30 because if the secondary attenuation means 50 was located a greater distance away from zone 54 in the same direction as idler rolls 30 the operator would have to reach in past the high speed advancing strands and bring the strand, which is about to be restarted, over or through the array of advancing strands, this not being desirable.

Furthermore, each of the secondary attenuation means 50 is laterally spaced from its associated zone 54 such that, in systems employing substrands as shown herein, one of the substrands can break out and bead down without disrupting the pulling of the fibers from the other portion of the bushing 10.

It is preferred that the feeders 10 of the forming sections 4, 5, and 6 be spaced apart and located substantially in a first, common vertical plane, with each of the applicators 18 being located substantially in a second, common vertical plane laterally spaced from the first vertical plane. Gathering shoes 22 and idler rolls 30 are oriented such that they have substantially parallel axis of rotation such that the strand advancing downward between the surface of the applicators 18 and surface of idler rolls 30 moves in a third plane oblique to the first and second vertical planes with the third oblique plane being tangent to the surface of the applicators 18. That is, the feeders, applicators, gathering shoes, idler rolls, and secondary guides are positioned such that the advancing strands are external to all the zones 54 of the forming sections 4, 5, and 6 to promote continuous operation in spite of a break out in any of the forming sections.

Second guide means 35 can be fastened to the frame of the primary attenuation means by any suitable means such as screw type fasteners to rigidly locate the second guide means with respect to the chopper 40 and idler rolls 30.

Second guide means 35 is comprised of block 200 having a stepped surface 202 positioned to orient advancing strands 26, 27 and 28 in a spaced apart array of strands on second guide means 35 and primary attenuation means 40. That is, strands 26, 27, and 28 are established as a spaced apart array on the surface of cot wheel 44.

Stepped surface 202 is formed by a plurality of grooves 204 in block 200; each of the grooves 204 is adapted to receive an individual strand advancing from one of the forming sections.

Figure 4:
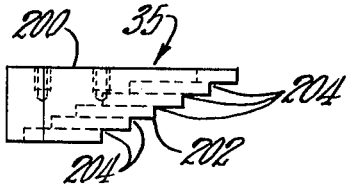
FIG. 4 is a plan view of the guide shown in FIG. 3.
Figure 3:
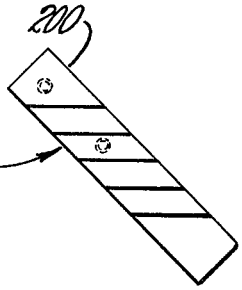
FIG. 3 is a front elevational view of the strand guide according to the principles of this invention.
Figure 5:
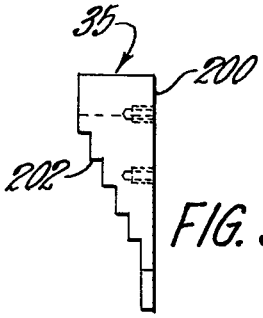
FIG. 5 is a side view of the guide shown in FIGS. 3 and 4.

As shown in FIGS. 3, 4, and 5, each of the grooves 204 is horizontally and laterally spaced from the groove adjacent thereto to facilitate rethreading when restarting a previously disrupted forming section. That is, block 200 is positioned with respect to cot roll 44 such that stepped surface falls within a plane generally oblique thereto. Thus, each of the strands 18 advanced along paths independent of the rest of the strands during operation.

During the operation of such multifeeder wet chop systems, it is desirable to maintain production from the feeders 10 in spite of process interruptions, such as break-outs and the like, by one of the other feeders, With high speed operations, it may be difficult and undesirable to rethread the disrupted feeder with the system operating at full speed. But the forming means or chopper 40 cannot be stopped, since the other feeders will be interrupted. Therefore, the speed of the chopper, the cot roll and/or cutter roll must be reduced to a second speed, slower than the first speed, to allow the operator to thread-up the strand to be restarted and yet maintain the other bushings in an operational mode.

It is apparent that within the scope of the invention, modifications and different arrangements can be made other than is herein disclosed. The present disclosure is merely illustrative with the invention comprehending all variations thereof.

I claim:

1. In apparatus for forming glass filaments having:

(a) a plurality of spaced apart forming sections wherein each section is comprised of:

(i) a feeder adapted to supply a plurality of streams of glass to be attenuated into continuous filaments, a zone being defined by the paths of the free falling streams;

(ii) applicator means laterally spaced from said zone adapted to apply a coating to the advancing filaments;

(iii) first guide means laterally spaced from said zone adapted to gather the filaments into a strand, the guide means and applicator means being positioned such that the coating is applied to the filaments external to said zone and intermediate the feeder and the first guide means along the path of advancement of the filaments; and (iv) secondary attenuation means laterally spaced from the zone adapted to advance said filaments as waste;

(b) a primary attenuation means adapted to simultaneously attenuate the streams from each section into filaments, the primary attenuation means having a roll associated therewith; and (c) second guide means positioned to advance the strands from each section external to said zones as the strands are advanced by the primary attenuation means; said feeders, applicator means, first guide means and second guide means being positioned such that said strands and waste are advanced along spaced apart paths external to all of said zones when advanced by the secondary attenuation means;

the improvement comprising said second guide means having a plurality of grooves adapted to orient said strands as a spaced apart array at said primary attenuation means wherein each of said grooves is vertically and laterally spaced from the groove adjacent thereto such that each of said strands initially contacts the surface of said roll at a point radially spaced from each of the adjacent strands.

2. The apparatus of claims 1 wherein said primary attenuation means is a chopper for severing continuous strands into discrete segments and wherein said roll is an idler roll associated with said chopper.

3. In a method of forming glass filaments by:

(a) establishing a plurality of forming operations wherein each forming operation is comprised of:

(i) supplying a plurality of streams of glass to be attenuated into continuous filaments, the paths of the free falling streams defining a zone;

(ii) positioning the filaments advancing from the feeder external to the zone;

(iii) gathering the filaments into a strand by a first guide means external to said zone;

(iv) positioning an applicator means external to the zone;

(v) applying a coating to the filaments at a region external to the zone at said applicator means, said region being along the path of advancement of the filaments intermediate the streams and the point of gathering the filaments into a strand; and (vi) positioning a secondary attenuation means external to the zone to attenuate the streams into filaments and advance the filaments as waste;

(b) providing a primary attenuation means adapted to simultaneously attenuate the streams from the feeders into filaments, the primary attenuation means having a roll associated therewith; and (c) positioning the feeders, applicator means, first guide means, and secondary attenuation means such that all of the advancing strands are moved along paths external to such zones and in the absence of contact between the waste and any other of said strands;

the improvement comprising: providing a second guide means having a plurality of grooves adapted to orient said strands as a spaced apart array at said primary attenuation means wherein each of said grooves is vertically and laterally spaced from the groove adjacent thereto such that each of said strands initially contacts the surface of said roll at a point radially spaced from each of the adjacent strands.

* * * * *